US007771542B1

(12) United States Patent
Hunt et al.

(10) Patent No.: US 7,771,542 B1
(45) Date of Patent: Aug. 10, 2010

(54) COMPOSITIONS AND METHODS FOR REMOVING LEAD FROM METAL SURFACES

(75) Inventors: David Hunt, Naperville, IL (US); George Kuhlmann, Aurora, IL (US)

(73) Assignee: Stone Chemical Company, Naperville, IL (US)

( * ) Notice: Subject to any disclaimer, the term of this patent is extended or adjusted under 35 U.S.C. 154(b) by 328 days.

(21) Appl. No.: 11/753,431

(22) Filed: May 24, 2007

Related U.S. Application Data

(60) Provisional application No. 60/803,462, filed on May 30, 2006.

(51) Int. Cl.
*C11D 11/00* (2006.01)

(52) U.S. Cl. ..... 134/3; 134/41

(58) Field of Classification Search ..... 134/3, 134/41

See application file for complete search history.

(56) References Cited

U.S. PATENT DOCUMENTS

| | | | | |
|---|---|---|---|---|
| 4,048,121 | A | 9/1977 | Chang | |
| 4,497,687 | A | 2/1985 | Nelson | |
| 4,919,752 | A | 4/1990 | Mika | |
| 5,076,954 | A | 12/1991 | Loth et al. | |
| 5,286,403 | A | 2/1994 | O'Dwyer et al. | |
| 5,397,397 | A | 3/1995 | Awad | |
| 5,454,876 | A | 10/1995 | Downey | |
| 5,707,421 | A | 1/1998 | Joe | |
| 5,919,519 | A | 7/1999 | Tallis | |
| 5,958,257 | A * | 9/1999 | Regelbrugge et al. | 216/2 |
| 6,197,210 | B1 * | 3/2001 | Myerson | 216/106 |
| 6,284,053 | B1 * | 9/2001 | Bonomi et al. | 134/3 |
| 6,383,643 | B1 * | 5/2002 | De Jarlais | 428/418 |
| 6,432,210 | B1 | 8/2002 | Cote et al. | |
| 6,447,616 | B1 | 9/2002 | Cote et al. | |
| 6,572,754 | B2 | 6/2003 | Reiter | |
| 6,652,661 | B2 | 11/2003 | Martin | |
| 6,830,629 | B2 | 12/2004 | Cote et al. | |
| 6,897,253 | B2 | 5/2005 | Schmucker-Castner et al. | |
| 6,936,579 | B2 | 8/2005 | Urban | |
| 2002/0043271 | A1 * | 4/2002 | Cote et al. | 134/1 |
| 2002/0123435 | A1 | 9/2002 | Ojima et al. | |
| 2002/0187918 | A1 | 12/2002 | Urban | |
| 2003/0098041 | A1 | 5/2003 | Cote et al. | |
| 2003/0111093 | A1 | 6/2003 | Cote et al. | |
| 2004/0135140 | A1 | 7/2004 | Cote et al. | |
| 2004/0265354 | A1 | 12/2004 | Ameri et al. | |
| 2005/0123507 | A1 | 6/2005 | Ameri et al. | |
| 2005/0124519 | A1 | 6/2005 | Sherry et al. | |

* cited by examiner

*Primary Examiner*—Gregory E Webb
(74) *Attorney, Agent, or Firm*—Clise, Billion & Cyr, P.A.; Michael Haukaas

(57) ABSTRACT

The invention provides an aqueous composition that includes a hydroxy-substituted mono-, di-, or tri-carboxylic acid; phosphoric acid; a surfactant; and water. The invention further provides a method for removing lead from the surface of metal, the method includes contacting a metal surface with an aqueous composition that includes a hydroxy-substituted mono-, di-, or tri-carboxylic acid; phosphoric acid; a surfactant; and water; to provide a metal surface with a reduced amount of leachable lead. The leachable lead on the surface of the metal can be reduced to below 1 ppb by using the composition described herein.

23 Claims, No Drawings

COMPOSITIONS AND METHODS FOR REMOVING LEAD FROM METAL SURFACES

RELATED APPLICATIONS

This application claims priority under 35 U.S.C. §119(e) to Provisional Patent Application Ser. No. 60/803,462, filed May 30, 2006, which application is incorporated herein by reference in its entirety.

BACKGROUND OF THE INVENTION

Metal fixtures, components and parts are commonly manufactured from metal alloys that contain various amounts of lead. These fixtures are often used in plumbing applications. Such applications include parts for water flow fixtures such as faucets, spouts, shower heads, plumbing pipes, pipe fittings, shut-off valves, water meters, pressure and flow regulators, ice makers, and the like.

In 1991 the National Primary Drinking Water Regulations established an action level of 15 ppb of lead in drinking water. In 1996 the Safe Water Drinking Act amendments reduced the allowable amount of lead in brass used for potable water supply systems to 8%. These regulations set forth limits for the maximum quantity of lead that is permitted to be leached into potable water systems from plumbing fixtures and other delivery components during periods of use and non-use. The United States Environmental Protection Agency (EPA) designated the National Sanitation Foundation (NSF) as the organization to establish the testing standards to meet the federal regulations. Those standards are now known as the NSF-61 standard. Numerous municipalities, counties, states, and other governing bodies now require compliance with the NSF-61 standard for products supplied for use in potable water delivery systems within their jurisdictions.

Many metal fixtures, components and parts do not meet the NSF standards at the time of manufacturing. Methods have been developed to treat the metal fixtures to remove lead from the surface of the plumbing fixtures, components and parts so that they meet the NSF standards and are thus safe to use in municipal and residential water supplies. Several problems and disadvantages are associated with the current methods for removing lead from metal fixtures. These problems and disadvantages include large amounts of toxic or undesirable waste products including caustic solutions, processing difficulties including multi-step procedures, the high costs associated with multi-step procedures, relatively high operating temperatures in some cases, and treating compositions that tarnish the metals.

Accordingly, what is needed are compositions and methods that can remove lead from metal surfaces with fewer problems and disadvantages than are associated with current compositions and methods. Such a composition would result in fewer undesirable waste products and would be less expensive to manufacture. The methods of treating the metal would require fewer steps and/or simpler procedures, lower operating temperatures, and thus lower costs to employ the methods.

SUMMARY

The invention provides metal treating composition that includes a hydroxy-substituted mono-, di-, or tri-carboxylic acid; phosphoric acid; and water. The composition can also optionally include one or more surfactants and/or optionally a sulfur-containing acid and/or an anti-foaming agent. The invention also provides a method for removing lead from the surface of metal, the method includes contacting a metal surface with an aqueous composition that includes a hydroxy-substituted mono-, di-, or tri-carboxylic acid; phosphoric acid; optionally a surfactant; and water; to provide a metal surface with a reduced amount of leachable lead. The composition can be used to reduce the amount of leachable lead on the surface of a metal to less than 2 parts per billion (2 ppb).

The composition and methods of the invention provide an improved method to reduce the amount of leachable lead from metals. Use of the methods results in a reduced amount of toxic or undesirable waste products. The methods are effective to reduce the amount of leachable lead from a metal surface to below certain proscribed limits as set forth in NSF-61 (such as less than 15 ppb or less than 11 ppb) (see for example, sections 4, 8, and 9 of NSF-61). The methods can also be effective to reduce the amount of lead from a metal surface to less than about 2 ppb, or to less than about 1 ppb.

The composition can clean, brighten, and/or passivate a metal surface. The methods described herein obviate the need for multiple bath operations by providing a single-bath or single-treatment method, optionally followed by either a single water rinse, or a neutralizing wash followed by a single water rinse. The composition is less expensive to prepare than most currently available treatment compositions that reduce the amount of leachable lead from a metal surface. Another advantage of the metal treating composition is that the need for a de-greasing or cleaning step in the treatment process can be obviated. Furthermore, the methods can be used at lower temperatures than current methods, and are thus less expensive to conduct. The methods also provide for shorter treatment times than currently employed methods, resulting in further economic savings to the user.

DETAILED DESCRIPTION OF THE INVENTION

The invention provides an aqueous composition that includes a hydroxy-substituted mono-, di-, or tri-carboxylic acid; phosphoric acid; optionally one or more surfactants (wetting agents); optionally an anti-foaming agent; optionally a sulfur-containing acid; and water. The invention further provides methods of cleaning and brightening metal and reducing the amount of leachable lead from the surface of metal. The aqueous composition can be prepared as a concentrate, for ease of transporting the composition from place to place prior to employing it as a cleaning, brightening, passivating, and/or an agent to reduce leachable lead content.

Definitions

As used herein, the term "contacting" refers to the act of touching, making contact, or bringing two or more components into immediate proximity.

As used herein, the term "passivate" refers to retarding oxidation or tarnishing of a surface. Passivating also retards further leaching of lead after a metal surface has been treated with a composition described herein.

As used herein, the phrase "reducing the amount of leachable lead from the surface of metal" refers to the treating process disclosed herein whereby the metal surface releases into water less than about 15 ppb of lead after about 14-19 days of testing, such as, for example, according to the testing standards set forth by National Sanitation Foundation Standard 61 (NSF-61). NSF-61 can also be interpreted as defining the leachable lead to no more than 15 ppb for each mL of the internal volume of the components delimited by metallic surfaces exposed to contact with potable water during testing. NSF-61 is incorporated herein by reference.

As used herein, the term "about" refers to a value that is greater than or less than the specified value by 5%, 10%, or 25%. The term "about" can also refer to a value that is greater than or less than the specified value by one or two integers.

As used herein, the term "aryl" refers to an aromatic hydrocarbon group. The aryl group can have both saturated or unsaturated carbon atoms in the parent ring system. The aryl group can have from 6 to about 14 carbon atoms in the parent ring system. The aryl group can have a single ring (e.g., phenyl) or multiple condensed (fused) rings, wherein at least one ring is aromatic (e.g., naphthyl, dihydrophenanthrenyl, fluorenyl, or anthryl). Typical aryl groups include, but are not limited to, benzene, naphthalene, anthracene, biphenyl, and the like. The aryl can be unsubstituted or optionally substituted with various functional groups.

As used herein, the term "alkyl" refers to a branched, unbranched, or cyclic hydrocarbon having, for example, from 1 to about 18 carbon atoms, and often 1 to about 12 carbon atoms. Examples include, but are not limited to, methyl, ethyl, 1-propyl, 2-propyl, 1-butyl, 2-methyl-1-propyl, 2-butyl, 2-methyl-2-propyl, 1-pentyl, 2-pentyl, 3-pentyl, 2-methyl-2-butyl, 3-methyl-2-butyl, 3-methyl-1-butyl, 2-methyl-1-butyl, 1-hexyl, 2-hexyl, 3-hexyl, 2-methyl-2-pentyl, 3-methyl-2-pentyl, 4-methyl-2-pentyl, 3-methyl-3-pentyl, 2-methyl-3-pentyl, 2,3-dimethyl-2-butyl, 3,3-dimethyl-2-butyl, 1,1,3,3-tetramethyl-1-butyl, hexyl, octyl, decyl, or dodecyl. The alkyl can be unsubstituted or substituted with various functional groups. The alkyl can also be optionally partially or fully unsaturated (e.g., to form an alkeneyl or an alkynyl group).

As used herein, the term "halo" refers to a fluoro, chloro, bromo, or iodo group.

Hydroxy-Substituted Mono-, Di-, or Tri-Carboxylic Acids

The metal treating composition includes one or more hydroxy-substituted carboxylic acids. The carboxylic acids can be, for example, mono-carboxylic acids, dicarboxylic acids, tricarboxylic acids, or a combination thereof. Polyhydroxy-carboxylic acids can be used in certain embodiments. The hydroxy-substituted carboxylic acid can be any hydroxy-substituted carboxylic acid that is suitable and effective in combination with the other components of the composition to reduce the amount of leachable lead from the surface of a metal. The hydroxy-substituted carboxylic acid can be substituted with one to about ten hydroxyl groups.

The hydroxy-substituted carboxylic acid can be a hydroxy-substituted ($C_2$-$C_8$)mono-carboxylic acid, for example, glycolic acid, 2-hydroxy-propionic acid (lactic acid), 3-hydroxy-propionic acid, hydroxy-butanoic acid isomers, hydroxy-pentanoic acid isomers, hydroxy-hexanoic acid isomers, hydroxy-heptanoic acid isomers, hydroxy-octanoic acid isomers, or combinations thereof. The hydroxy-substituted carboxylic acid can also be a ($C_2$-$C_8$)dicarboxylic acid or a hydroxy-substituted aromatic carboxylic acid. In one embodiment, the hydroxy-substituted carboxylic acid is glycolic acid. In another embodiment, the hydroxy-substituted carboxylic acid can be gluconic acid, salicylic acid, citric acid, or a combination thereof. In other embodiments, the hydroxy-substituted carboxylic acid is not citric acid.

The metal treating composition can include about 0.01 wt. % to about 20 wt. % of a hydroxy-substituted carboxylic acid. In various embodiments, the composition can include about 2 wt. % to about 15 wt. % of a hydroxy-substituted carboxylic acid; about 3 wt. % to about 7 wt. % of a hydroxy-substituted carboxylic acid; about 3 wt. % to about 5 wt. % of a hydroxy-substituted carboxylic acid; or about 3 wt. % to about 4 wt. % of a hydroxy-substituted carboxylic acid.

Phosphoric Acid

The metal treating composition includes phosphoric acid. The composition can include about 0.01 wt. % to about 10 wt. % phosphoric acid. In certain embodiments, the composition includes about 0.5 wt. % to about 8 wt. % phosphoric acid; about 1 wt. % to about 5 wt. % phosphoric acid; about 1 wt. % to about 4 wt. % phosphoric acid; or about 2 wt. % to about 3 wt. % phosphoric acid. In one specific embodiment, the composition includes about 1.5 wt. % to about 2.0 wt. % phosphoric acid.

Sulfur-Containing Acids

The metal treating composition may include 0.01 wt % to 10 wt % of a sulfur-containing acid with one acid group and substituents that may include amido-, phenyl-, substituted phenyl-, methyl-, or substituted methyl-groups. In one specific embodiment, the composition includes mono-substituted sulfonic acids such as amidosulfonic acid or phenylsulfonic acid.

Surfactants

The metal treating aqueous composition can optionally include one or more surfactants. The surfactant can be completely miscible with the water component of the composition at the concentrations described herein. The surfactant can be one or more non-ionic surfactants, anionic surfactants, cationic surfactants, amphoteric surfactants, or combinations thereof. In one embodiment, the composition includes only one, or one type of, surfactant.

The surfactant can be an ethoxylated surfactant. The surfactant can be an aryl surfactant. The aryl surfactant can be optionally substituted with one to about five ($C_1$-$C_{12}$)alkyl, alkoxy, halo (e.g., F, Cl, Br, or I), nitro, trifluoromethyl, or sulfonyl groups, or combinations thereof. In various embodiments, the aryl surfactant is substituted with one, two, three, four, or five ($C_1$-$C_{12}$)alkyl groups. In one embodiment, the aryl surfactant is substituted with a $C_8$-alkyl group. In one specific embodiment, the aryl surfactant is substituted with 1,1,3,3-tetramethyl-butane.

An ethoxylated surfactant can be substituted with one to about five poly(ethoxy) groups. The poly(ethoxy) group can have 2 to about 20 ethoxy units. In one embodiment, the poly(ethoxy) group has about 5 to about 15 ethoxy units. In another embodiment, the poly(ethoxy) group has about 6 to about 12 ethoxy units. In yet another embodiment, the poly (ethoxy) group has about 9 to about 10 ethoxy units.

In one embodiment, the surfactant is a compound of formula I:

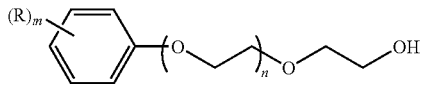

(I)

wherein m is 0 to 5;

n is about 6 to about 12; and

R is a straight, branched, or cyclic ($C_1$-$C_{12}$)alkyl group.

In one embodiment, the surfactant is a compound of formula I wherein m is 0, 1, 2, or 3. In another embodiment, n is about 8 or about 9. In yet another embodiment, R is a branched chain $C_s$-alkyl group, or a $C_9$-alkyl group. In one specific embodiment, m is one; n is 8 or 9; and R is 1,1,3,3-tetramethyl-butane.

The metal treating composition can include about 0.5 wt. % to about 10 wt. % of the surfactant. In various embodiments, the composition includes about 1 wt. % to about 8 wt. % of the surfactant; about 1 wt. % to about 5 wt. % of the surfactant; or about 2 wt. % to about 4 wt. % of the surfactant.

Anti-Foaming and Defoaming Agents

The metal treating composition can optionally include one or more anti-foaming agents and/or one or more anti-foaming agents. Anti-foaming agents and defoaming agents are additives that reduce the surface tension of a solution or emulsion, thus inhibiting or modifying the formation of a foam. The anti-foaming agent can be used to prevent formation of foam or can be added to break a foam already formed. Typical anti-foaming agents include insoluble oils, silicone polymers, for example, dimethyl polysiloxanes, and other silicones, alcohols, stearates, and glycols, or low foaming surfactants that serve the same purpose/function. Certain specific anti-foaming agents include, but are not limited to, triethyl citrate, polydimethylsiloxane, and polyethylene glycol, such as polyethylene glycol 8000.

The metal treating composition can include about 0.25 wt. % to about 20 wt. % of the anti-foaming agent. In various embodiments, the composition includes about 1 wt. % to about 8 wt. % of the anti-foaming agent; about 1 wt. % to about 5 wt. % of the anti-foaming agent; or about 2 wt. % to about 4 wt. % of the anti-foaming agent. Typically, the composition can include about one-fourth to about four times the amount of anti-foaming agent compared to the amount of surfactant.

Water

The metal treating composition can include at least about 60 wt. % water. The composition can also include at least about 70 wt. % water. The water can be tap, de-ionized, distilled, or reverse osmosis (RO) water. In one embodiment, the composition includes about 70 wt. % to about 99 wt. % water. In another embodiment, the composition includes about 85 wt. % to about 96 wt. % water. In yet another embodiment, the composition includes about 90 wt. % to about 95 wt. %. In another embodiment, the composition includes about 91 wt. % to about 94 wt. % water.

The composition of the invention can also be diluted with water, which accordingly lowers the wt. % of the other components of the composition with respect to water. The composition can be diluted with any amount of water that allows for the composition to suitably remove lead from the surface of a metal. In one embodiment, the composition can be diluted with about 0.25 to about 100 volumes of water. In another embodiment, the composition can be diluted with about 2 to about 20 volumes of water. In yet another embodiment, the composition can be diluted with about 5 to about 15 volumes of water. In one specific embodiment, the composition can be diluted with about 9 or about 10 volumes of water.

Acid Neutralizing Agents

After lead removal treatment, weakly alkaline compounds such as sodium acetate, potassium acetate, borax, sodium bicarbonate, disodium phosphate, or similar compounds can be applied as a rinse to the metal surface to neutralize residues of the lead removal acids without harming the treated surface of the metal. The acid neutralizing composition can include at least about 60% water. The composition can also include at least about 70 wt. % water. The water can be tap, de-ionized, distilled, or reverse osmosis (RO) water. In one embodiment, the rinse composition includes about 70 wt. % to about 99 wt. % water. In another embodiment, the rinse composition includes about 85 wt. % to about 96 wt. % water. In yet another embodiment, the rinse composition includes about 90 wt. % to about 95 wt. %.

The acid neutralizing rinse can be preceded and/or followed by a water rinse. The acid neutralizing rinse can optionally contain one or more surfactants.

General Properties of the Compositions

In one embodiment, the metal treating composition includes a hydroxy-substituted mono-, di-, or tri-carboxylic acid; phosphoric acid; one or more surfactants (wetting agent); water; and other components such as an anti-foaming agent. In another embodiment, the metal treating composition consists only of a hydroxy-substituted mono-, di-, or tri-carboxylic acid; phosphoric acid; a surfactant; and water. In one specific embodiment, the composition includes only a hydroxy-substituted mono-carboxylic acid; phosphoric acid; and water. In another specific embodiment, the composition includes only a hydroxy-substituted mono-carboxylic acid; phosphoric acid; an aryl ethoxylated surfactant; and water. In another specific embodiment, the composition includes only glycolic acid, phosphoric acid; an aryl ethoxylated surfactant; and water. In another specific embodiment, the composition includes only glycolic acid, phosphoric acid; an aryl ethoxylated surfactant, a sulfur-containing acid; and water. In another embodiment, the metal treating composition includes a glycolic acid; phosphoric acid; and water.

The pH of the composition can be about 0.5 to about 5. The pH of the composition can also be about 1 to about 4, or about 2 to about 3. In one embodiment, the pH of the composition is about 1.5 to about 2.5. In another embodiment, the pH of the composition is about 1.5 to about 2.2. When the composition is diluted with water, the pH of the composition will increase. For example, in one embodiment, the composition is diluted with 5-15 volumes of water and accordingly, the pH of the composition rises to the range of about 1.5 to about 3.5.

Making and Using the Compositions of the Invention

The composition can be prepared by mixing the reagents in any given order. Typically, the phosphoric acid is added to a large (greater than about 50 wt. % of the final composition) amount of water. To this solution is added the surfactant, followed by the carboxylic acid component. The addition is typically carried out with mixing.

The hydroxy-substituted carboxylic acid can be added to the other reagents in the composition neet or as part of an aqueous solution. In one embodiment, the hydroxy-substituted carboxylic acid is glycolic acid, which is added to the mixture as 70% technical glycolic acid (30% water).

The phosphoric acid can be added to the mixture neet or as part of an aqueous solution. In one embodiment, the phosphoric acid is added to the mixture as 75% phosphoric acid (25% water). Likewise, the surfactant can be added neet or as part of an aqueous solution or mixture.

The metal treating composition can be used to treat a metal surface to improve various properties of the metal surface. The treating can be for a variety of purposes. Typically, the composition is used to clean a metal surface, brighten a metal surface, passivate a metal surface, reduce the amount of leachable lead from a metal surface, or a combination thereof.

The metal surface is treated by contacting the metal surface with the composition. The contacting can be carried out by spraying, wetting, wiping, soaking, immersing, and the like, a combination thereof, or by any other appropriate method. The metal surface can be contacted with the composition for about 1 minute to about one day. Typically, the metal surface is contacted with the composition for about 1 minute to about one or several hours. In one embodiment, the metal surface is contacted with the composition for about 5, about 10, about 15, about 20, about 25, about 30, or about 60 minutes. In certain specific embodiments, the metal surface is contacted with the composition for about 5 to about 30 minutes, or about 5 to about 20 minutes.

The contacting can be carried out with various procedures to ensure adequate contact of the composition with the metal surface. These procedures include rotating the metal parts that have the metal surface, and other agitation procedures, such as mechanical, gaseous, or fluid agitation procedures. These procedures can include shaking, stirring, or the use of sonic and/or ultrasonic vibrations. A bath of the metal treating solution can also be agitated by forcing a gas, such as air or nitrogen, through the bath.

The contacting can be carried out at any suitable and effective temperature. The compositions can sufficiently reduce the amount of leachable lead from the surface of a metal when the metal surface is contacted with the composition at about room temperature (about 60° F.) up to about 212° F. In one embodiment, the composition works effectively at about room temperature (about 70° F.) up to about 165° F. The temperature employed can also be about 80° F. to about 100° F. In another embodiment, the temperature employed is about 90° F. to about 100° F. In yet another embodiment, the temperature employed is about 95° F. Above about 100° F., the metal surface of some metals may become activated in the acidic media and may begin to tarnish. If the metal is tolerant, the temperature can be raised to about 165° F. Accordingly, in one embodiment the composition is contacted with the metal surface at less than about 100° F., or less than about 105° F. When the metal being treated is brass, contacting the brass at less than about 98° F., or less than about 101° F. does not result in tarnishing or corrosion of the brass surface. When the metal being treated has a rough surface with a large surface area, such as cast or forged brass with or without machined surfaces, higher treatment temperatures to 165° F. may be employed followed by an optional neutralization wash.

Treating a metal surface with the composition allows for the removal of leachable lead from the surface of the metal. The amount of leachable lead can be reduced to below about 15 ppb, as determined by inductively coupled plasma mass spectrometry, or other appropriate methods, and in accordance with NSF-61. The amount of leachable lead can also be reduced to below about 10 ppb, below about 8 ppb, below about 5 ppb, below about 3 ppb, or to below about 1 ppb.

After the metal surface has been treated with the composition, the metal surface can optionally be rinsed with water to remove any remaining components of the composition. Typically only one rinse or immersion in water is required to rinse off any remaining components of the composition. Optionally, the entire treatment procedure can be repeated more than once without negative effects.

The metal treating composition has an acidic pH. Alkaline compositions (especially, for example, those with a pH above about 9) can cause or increase the rate of oxidation or tarnishing of a metal surface. When treating the surface of a metal to remove leachable lead, it is often desirable to maintain or improve the appearance of the surface. Accordingly, the composition typically does not contain alkaline components. The method of treating metal surfaces does not include employing alkaline baths. In certain embodiments, the composition does not include alkali metal hydroxides or alkaline earth metal hydroxides. Likewise, the composition can be absent of alkali metal carbonates or alkaline earth metal carbonates.

The composition can also be absent, or essentially absent, of ionic compounds. Examples of ionic compounds that can be excluded from the composition include various metal salts, including alkali metal salts, alkaline earth metal salts, and transition metal salts. Some examples of such ionic compounds include silicates, such as sodium silicate or sodium metasilicate. In another embodiments, the composition is not prepared from, or does not contain carboxylate salts, such as, for example, sodium gluconate and disodium EDTA. In yet another embodiment, the composition does not include EDTA. In a further embodiment, the composition does not include iron halides, such as, for example, iron chloride, or sulfate salts, such as sodium persulfate.

The composition can also be absent, or essentially absent of alkane, alkanol, or non-water solvents. For example, the composition typically includes less than about 10 wt. %, less than about 5 wt. %, less than about 1 wt. %, or 0 wt. % alkane, alkanol, or non-water solvent whatsoever. As mentioned previously, the composition can also be free of ammonium salts. Some embodiments of the invention exclude optionally substituted ($C_1$-$C_9$)organic compounds not specifically described for use in the composition of the invention. Other embodiments exclude optionally substituted ($C_{10}$-$C_{30}$)organic compounds not specifically described for use in the composition of the invention. Other embodiments of the invention exclude polymers, for example, gelling agents, such as polycellulose or polyacrylates. In another embodiment, the composition absent of nitric acid, hydrochloric acid, sulfuric acid, metal oxides, and/or perfumes.

Compositions that contain organic amines or ammonium salts can cause stress cracking or degradation on the surface or into the body of a metal object, especially in yellow metals such as brass, copper, and bronze. Accordingly, the composition can be absent of any component known to cause stress cracking or degradation of yellow metals (for example organic amines or ammonium salts). In some embodiments, the metal treating composition can be absent, or essentially absent of amines or ammonium salts. For example, the composition can include less than about 10 wt. %, less than about 5 wt. %, less than about 1 wt. %, or 0 wt. % of an amine. Typically, the composition does not contain any organic amine or ammonium salt component whatsoever.

In one embodiment, the composition consists of water, phosphoric acid, a hydroxy-substituted carboxylic acid, and no other components. The composition can also consist of consists of water, phosphoric acid, a hydroxy-substituted carboxylic acid, a surfactant, and no other components. In another embodiment, the composition consists essentially of water, phosphoric acid, a hydroxy-substituted carboxylic acid, and no other components that materially affect the composition's effectiveness to remove lead from a metal surface. The composition can also consist essentially of water, phosphoric acid, a hydroxy-substituted carboxylic acid, a surfactant, and no other components that materially affect the composition's effectiveness to remove lead from a metal surface. The composition can be a solution, for example, a composition that is not an emulsion. In other embodiments, the composition can optionally contain a sulfur-containing acid and/or optionally an anti-foaming agent.

From time to time it may be advantageous to fully stabilize the surface of the metal by utilizing a neutralizing rinse after lead removal treatment. Such rinses may contain weakly alkaline compounds such as sodium acetate, potassium acetate, borax, sodium bicarbonate, disodium phosphate, or other suitable compounds, which would neutralize residues of the lead removal acids without harming the treated surface of the metal.

Metals

The composition can be used to reduce the leachable lead content of a wide variety of metals. The metal can be substantially (greater than about 98 wt. %) pure elemental metal, or the metal can be any of a variety of alloys. Typically, the metal contains various amounts of lead that can be leached from the surface of the metal when contacted with water, such as over an extended period of time. The metal treating composition is well suited for treating metal parts, such as for various plumbing, potable water and other applications.

The metal that is treated with the metal treating composition can be a transition metal, for example, a Group IVB metal, a Group VB metal, a Group VIA metal, a Group VIB metal, a Group VIIA metal, a Group VIM metal, a Group VIII metal, a Group IB metal, a Group IIB metal, a Group IVA metal, or an actinide. Specific examples of metals that can be treated include, but are not limited to, titanium, vanadium, chromium, molybdenum, manganese, iron, cobalt, nickel, palladium, platinum, copper, silver, gold, zinc, cadmium, tin, uranium, or combinations thereof.

The metal that is treated with the metal treating composition can be a non-ferrous metal. In one specific embodiment, the metal can be brass, such as, for example, yellow brass or red brass. In another embodiment, the metal can be copper or zinc. In yet another embodiment, the metal can be bronze. In various embodiments, the metal can be silver, palladium, platinum, nickel, or aluminum. In other embodiments, the metal can be a ferrous metal, such as, for example, iron, steel, or stainless steel. The metal surface can include a combination of any of the aforementioned metals. The metal surface can include non-metal components as well.

The following examples are given by way of illustration only and are not to be considered limitations of this invention and many apparent variations are possible without departing from the spirit and scope of the invention.

EXAMPLES

Example 1

Lead removal from Leaded Brass Parts at about 100° F.

Lead removal from leaded brass parts using a metal treating composition "Composition A" containing glycolic acid (a composition of the invention) was compared to lead removal using an aqueous glycolic acid/surfactant solution. Both treatments were carried out at about 100° F. Composition A was prepared as follows. About 3 wt. % of 75% phosphoric acid was added to about 89 wt. % DI water, followed by the addition of about 3 wt. % of a surfactant. Finally, about 5 wt. % of 70% technical glycolic acid was added to the solution. Each component was added with stirring.

A 10 volume percent aqueous solution of the Composition A treatment was compared to an aqueous solution of glycolic acid and the surfactant as shown below in Table 1.

TABLE 1

Test Parameters and Results

| Test Parameter | Composition A | Glycolic Acid and Formula I Surfactant |
|---|---|---|
| Temperature, ° F. | 100 | 100 |
| Time, minutes | 5 | 5 |
| Composition A, vol % | 10 | 0 |
| Glycolic Acid, vol % | —* | 5 |
| Formula I surfactant, wt. % | — | 0.5 |
| Visual Test Results | Clean and Bright | Clean and Bright |
| Lead Test Results | No Detectable Lead | Some Lead Found |

*Composition A contains 4-5 wt. % glycolic acid; no additional glycolic acid was added.

The lead test kit employed was "LeadCheck Swabs", distributed by Hybrivet Systems, Inc. (P.O. Box 1210, Framingham, Mass. 01701; www.leadcheck.com). The chemical spot tests using LeadCheck Swabs detect lead in paint at 1.0 mg/cm$^2$ or 0.5% within a 95% confidence level, and can detect lead at levels below 0.5% with gradually decreasing confidence levels. The Examples described herein employed a mixture of 26-(4-(2,4,4-trimethylpentan-2-yl)phenoxy)-3,6,9,12,15,18,21,24-octaoxahexacosan-1-ol and 29-(4-(2,4,4-trimethylpentan-2-yl)phenoxy)-3,6,9,12,15,18,21,24,27-nonaoxanonacosan-1-ol as the Formula I surfactants. The results of performance curves developed from the LeadCheck Swaps test kits conform to the range of ideal performance curves expected for a spot test kit as defined by the EPA for lead paint surfaces.

Results: The tests demonstrated that lead could be successfully removed from leaded brass fittings using Composition A. The glycolic acid/Formula I surfactant composition at 100° F. had a hint of pink test color indicating that at least 1 microgram (~1,000 ppb) of lead was present, which is unacceptable under NSF standards.

Example 2

Superior Results of Composition A vs. Other Combinations

To compare Composition A (Example 1) to various other combinations of components, a series of tests were conducted. Table 2 provides the results for these tests, conducted according to the parameters outlined above in Example 1.

TABLE 2

| | Experiment No. | | | | | |
|---|---|---|---|---|---|---|
| | 1 | 2 | 3 | 4 | 5 | 6 |
| DI Water, g | 500 | 500 | 500 | 500 | 500 | 500 |
| 75% Phosphoric Acid, g | 1.35 | 0 | 0 | 1.35 | 1.35 | 0 |
| 70% Glycolic Acid, g | 0 | 2.35 | 0 | 0 | 2.35 | 0 |
| Formula I surfactant, g | 0 | 0 | 1.45 | 1.45 | 0 | 0 |

TABLE 2-continued

| | Experiment No. | | | | | |
|---|---|---|---|---|---|---|
| | 1 | 2 | 3 | 4 | 5 | 6 |
| Composition A - Lead Removal Solution, vol % | 0 | 0 | 0 | 0 | 0 | 10 |
| Lead Swab Test Results* | Failure Faint Pink | Failure Faint Pink | Failed | Failed | Passed | Passed |
| Parts Appearance | Slightly improved | Brighter | Clean but Dulled | Slightly improved | Brighter | Brightest |

*Lower Delectability Limit is 1,000 ppb as indicated by a very faint pink color. Failure indicated by deep pink or red colors.

The experiments indicated that a Formula I surfactant is not essential for lead removal from these brass parts but was important to maintain and improve the appearance of the metal. Without the surfactant present, it would be necessary to have a pre-treatment phase to clean the parts prior to the lead removal process in order to remove surface soils, oil, other contaminants, or any other contaminant that would prevent the composition from fully contacting the surface of the metal. Omitting the Formula I surfactant could require one or more separate pre-treatment or post-treatment steps (washes, rinses, etc.) in order to obtain metal surfaces that are ready for commercial sales and/or use.

Example 3

Lead Removal from Leaded Brass Parts Using Composition A

Brass used for machining is often manufactured with varying amounts of lead in the brass metal for improved machinability and lubricity. "Leaded" brass can contain about 3 wt. % lead, or more. The amount of "leachable" lead on the surface of brass components is typically in the range of about 10 ppb to about 100 ppb, and can often reach thousands of ppb.

Example 3 demonstrates that a composition of the invention successfully reduced the amount of leachable lead content from the surface of brass parts to less 2 ppb at a testing pH of 10, and to less than 1 ppb at a testing pH of 5.

Table 3 illustrates the conditions used to determine the amount of leachable lead remaining in brass parts after treatment with Composition A. The sample parts were treated with Composition A (described in Example 1) or a control (water only). The treated test samples were tested for lead testing by a compact version of Section 8 of NSF-61. Inductively coupled plasma mass spectrometry (ICP-MS) was used to determine the amount of leachable lead remaining in the parts. In this Example, the contact time was varied.

TABLE 3

| | Sample Run | | | |
|---|---|---|---|---|
| | 1 | 2 | 3 | 4 |
| Sample | Control | Treated with Composition A: 5 Minutes | Treated Composition A: 10 Minutes | Treated Composition A: 15 Minutes |
| Treatment | Control | 10 vol. % Composition A | 10 vol. % Composition A | 10 vol. % Composition A |
| Time, minutes | 5 | 5 | 10 | 15 |
| Temperature, ° F. | Ambient | 95 | 95 | 95 |
| Post-Treatment Water Rinse at Ambient Temperature | Yes | Yes | Yes | Yes |
| | Average Lead Leaching Test Results, Lead ppb* | | | |
| Brass part tested at pH = 5 | 8.6 | 0.44 | 0.39 | 0.35 |
| Brass part tested at pH = 10 | 13.56 | 1.21 | 0.92 | 0.88 |

*The testing was conducted according to the requirements of NSF-61 Section 8.

Results: Composition A, even at 10 vol. %, readily lowered leachable lead levels from the surface of brass parts to acceptable EPA levels, even with only five minutes of treatment with Composition A. Composition A reduced leachable lead from the samples to levels that were about 10 to about 25 times lower than the control, depending on the treatment conditions employed.

Example 4

Lead Removal from Lead Cast Brass Parts Using Compositions B and C

Lead removal from cast brass alloy C84400 parts using metal treating compositions: Composition B and Composition C were compared. Composition B was prepared as follows. About 5 wt % of 75% phosphoric acid was added to about 83 wt % water, followed by the additional of about 3 wt % of a Formula I surfactant and about 9 wt % of 70% glycolic acid. Composition C was prepared by a similar procedure as for Composition B with the addition of about 2-wt % sulfamic acid. Each component was added with stirring. An additional acid neutralizer rinse (Composition D) was utilized with Composition C. Composition D was prepared by the addition of about 5-wt % sodium bicarbonate to 95-wt % water.

TABLE 4

Test Parameters and Results

| | Experiment Number | |
|---|---|---|
| | 1 | 2 |
| Composition | B | C |
| Concentration, vol %* | 50 | 50 |
| Temperature, ° F. | 140 | Ambient |
| Time, minutes | 10 | 10 |
| Deionized Water Rinse | Yes | Yes |
| Acid Neutralization | No | Yes (Composition D) |
| Temperature, ° F. | — | Ambient |
| Time, minutes | — | 5 |
| Deionized Water Rinse | — | Yes |
| Visual Test Results | Clean and Bright | Clean and Bright |

*Thus the composition was diluted with one part water, thereby creating a 1 part B, 1 part water, solution; and a 1 part C, 1 part water, solution.

Lead tests on the treated parts were conducted in two parallel but independent tests according to the requirements of NSF-61 Section 8 at pH=10 where:

U=Untreated Control

L=50 Vol % Composition B

S=50 Vol % Composition C followed by Composition D

The treated test samples were tested for lead by a more aggressive, compact version of NSF-61 Section 8 for 3 days instead of 14-19 days. This test reflects a "worst case scenario" because the highest levels of leachable lead are removed from the metal surface during this period. The results clearly indicated a major reduction in leachable surface lead was achieved by treating the cast brass parts with both Compositions B and C.

TABLE 5

Test Parameters and Results
Lead Leached Into Test Water at 140° F. at pH = 10

| Sample ID | Number of Samples | Sample Set | Day 1 Lead, ppb | Day 2 Lead ppb | Day 3 Lead ppb |
|---|---|---|---|---|---|
| U | 3 | 1 | 53.5 | 46.3 | 45.5 |
| L | 3 | 1 | 0.9 | 0.9 | 0.8 |

TABLE 5-continued

Test Parameters and Results
Lead Leached Into Test Water at 140° F. at pH = 10

| Sample ID | Number of Samples | Sample Set | Day 1 Lead, ppb | Day 2 Lead ppb | Day 3 Lead ppb |
|---|---|---|---|---|---|
| S | 3 | 1 | 0.8 | 0.5 | 0.3 |
| U | 3 | 2 | 45.3 | 43.7 | 43.2 |
| L | 3 | 2 | 0.8 | 0.8 | 0.7 |
| S | 3 | 2 | 0.7 | 0.6 | 0.6 |

These results clearly indicate that this invention has enabled a simple yet reliable method for the removal of leachable lead from metal surfaces, such as brass, to environmentally safe levels near or below 1 ppb. The compositions and methods of the invention can thereby replace the use of harsh and costly chemicals in multi-step processes, which require expensive equipment, and stringent environmental and safety controls. This invention uses a water-based process at ambient or above ambient temperature, short treatment times, and an optional final water rinse or clean-up to achieve both cleaning of the parts and removal of leachable lead from the metal surfaces.

All publications, patents, and patent documents are incorporated by reference herein, as though individually incorporated by reference. The invention has been described with reference to various specific and preferred embodiments and techniques. However, it should be understood that many variations and modifications may be made while remaining within the spirit and scope of the invention.

What is claimed is:

1. A method for removing lead from the surface of metal, the method comprising contacting a metal surface with an aqueous composition comprising:

a) a hydroxy-substituted mono-, di-, or tri-carboxylic acid;

b) phosphoric acid;

c) optionally a sulfur-containing acid;

d) optionally a surfactant; and e) water;

to provide a metal surface with a reduced amount of leachable lead.

2. The method of claim 1 wherein the aqueous composition further comprises an anti-foaming agent, a defoaming agent, or both.

3. The method of claim 1 wherein the aqueous composition comprises about 0.01 wt. % to about 14 wt. % of a hydroxy-substituted mono- or di-carboxylic acid; about 0.01 wt. % to about 12 wt. % phosphoric acid; optionally about 0.01 wt. % to about 10 wt. % of a surfactant; optionally 0.01 wt % to 10 wt % of a sulfur-containing acid, and about 56 wt. % to about 99.7 wt. % water.

4. The method of claim 3 wherein the aqueous composition is diluted with water prior to contacting the metal surface.

5. The method of claim 1 wherein the contacting is carried out for about 1 minute to about 60 minutes.

6. The method of claim 1 wherein the contacting is carried out at a temperature of about 60° F. to about 165° F.

7. The method of claim 1 wherein the leachable lead on the surface of the metal is reduced to below about 15 ppb.

8. The method of claim 1 wherein the metal is brass, copper, bronze, silver, nickel, palladium, platinum, steel, stainless steel, or a combination thereof.

9. The method of claim 1 wherein the metal comprises a non-ferrous metal, or a combination of non-ferrous metals.

10. The method of claim 1 further comprising rinsing the surface of the metal with water or an acid neutralizing composition comprising:

a) sodium acetate, potassium acetate, borax, sodium bicarbonate, disodium phosphate, or a combination thereof;

b) an optional surfactant or surfactants; and c) water;

wherein the composition has a pH of about 7.5 to about 10.5, and the composition neutralizes any remaining residue of the lead removal composition acids without tarnishing the surface of the metal.

11. The method of claim 1 wherein the composition contains the sulfur-containing acid and the metal is contacted at about 60° F. to about 180° F.;

further comprising contacting the metal surface with a separate batch of the composition, wherein the second batch of the composition is free or essentially free of a sulfur-containing acid, and wherein the second batch is contacted to the metal surface at about 60° F. to about 180° F.

12. The method of claim 1 wherein the composition does not contain a sulfur-containing acid and the metal surface is contacted at about 60° F. to about 180° F.;

further comprising contacting the metal surface with a separate batch of the composition, wherein the second batch of the composition comprises a sulfur-containing acid, and wherein the second batch is contacted to the metal surface at about 60° F. to about 180° F.

13. A method for removing lead from the surface of brass, the method comprising:

i) contacting a brass surface with an aqueous composition comprising:

a) about 3 wt. % to about 14 wt. % of a hydroxy-substituted mono- or di-carboxylic acid;

b) about 1 wt. % to about 8 wt. % phosphoric acid;

c) about 2 wt. % to about 5 wt. % of a surfactant;

d) optionally about 2 wt % to about 3 wt. % of a sulfur containing acid;

e) about 70 wt. % to about 95 wt. % water; and for about 1 minute to about 60 minutes at a temperature of about 70° F. to about 140° F., wherein the aqueous composition is optionally diluted by about 1 to about 20 parts water prior to contacting the brass surface; and wherein the pH of the aqueous composition is about 0.5 to about 5 and the amount of leachable lead on the surface of the brass is reduced to below about 15 ppb;

ii) optionally rinsing the surface of the brass with water to provide a brass surface with a reduced amount of leachable lead;

iii) optionally rinsing the surface of the brass with an acid neutralizing solution to provide a brass surface free of residual acidity, and optionally preceded and followed by a water rinse, wherein the acid neutralizing solution comprises sodium acetate, potassium acetate, borax, sodium bicarbonate, disodium phosphate, or a combination thereof.

14. The method of claim 13 wherein the leachable lead on the surface of the brass is reduced to below about 2 ppb.

15. The method of claim 3 wherein the carboxylic acid is an aromatic carboxylic acid or a ($C_2$-$C_8$)carboxylic acid.

16. The method of claim 3 wherein the mono-, or di-carboxylic acid is a mono-carboxylic acid.

17. The method of claim 16 wherein the mono-carboxylic acid is glycolic acid.

18. The method of claim 3 wherein the composition comprises about 0.01 wt. % to about 10 wt. % of a sulfur-containing acid.

19. The method of claim 18 wherein the sulfur-containing acid is sulfamic acid.

20. The method of claim 1 wherein the composition comprises a non-ionic surfactant.

21. The method of claim 20 wherein the non-ionic surfactant is an ethoxylated aryl surfactant optionally substituted with one to three ($C_1$-$C_{12}$)alkyl groups.

22. The method of claim 20 wherein the non-ionic surfactant is a compound of formula I:

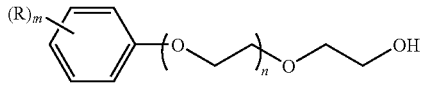

(I)

wherein m is 0 to 3;

n is about 6 to about 12; and

R is a straight, branched, or cyclic ($C_1$-$C_{12}$)alkyl group.

23. The method of claim 13 wherein the composition further comprises an anti-foaming agent, a defoaming agent, or both.

* * * * *